United States Patent [19]

Lisiecki

[11] Patent Number: 4,520,929

[45] Date of Patent: Jun. 4, 1985

[54] FLAT TOP END CLOSURE FOR LIQUID CONTAINER

[75] Inventor: Robert E. Lisiecki, Orchard Lake, Mich.

[73] Assignee: Ex-Cell-O Corporation, Troy, Mich.

[21] Appl. No.: 615,641

[22] Filed: May 31, 1984

[51] Int. Cl.[3] ..... B65D 3/20; B43M 7/00

[52] U.S. Cl. ..... 206/610; 206/613; 206/605

[58] Field of Search ..... 206/605, 604, 608, 610, 206/611, 612, 613, 614, 615

[56] References Cited

U.S. PATENT DOCUMENTS

| | | | |
|---|---|---|---|
| 3,074,610 | 1/1963 | Pugh | 206/229 |
| 3,115,293 | 12/1963 | Hovland | 206/605 |
| 3,120,333 | 2/1964 | Seiple | 229/37 R |
| 3,625,270 | 12/1971 | Skeno | 206/605 |
| 4,091,930 | 5/1978 | Buchner et al. | 206/605 |

FOREIGN PATENT DOCUMENTS

| | | | |
|---|---|---|---|
| 533895 | 10/1955 | Italy | 229/52 A |

*Primary Examiner*—Joseph Man-Fu Moy
*Attorney, Agent, or Firm*—John P. Moran

[57] ABSTRACT

A flat top liquid carrying, paperboard container including four side panels, and inner and outer pairs of top closure panels alternately connected by respective horizontal score lines to the top edges of the four side panels as extensions thereof. While the inner pair of top closure panels each typically includes a substantially triangular panel portion and a pair of integrally connected fold-back panels, the outer pair consists of one shorter and one longer panel. A fold-over panel segment is formed on the end of the shorter panel. A diagonal opening-assist score line is formed on each of the shorter and longer panels, and a reverse diagonal opening-assist score line is formed on the fold-over panel segment extending from an end of the adjacent diagonal score line for lying on top of the latter when the fold-over panel segment is folded. A lift tab is formed on a side edge of the longer panel and extends past a portion of the edge of the adjacent fold-back panel. A perforated line for forming a tear strip extends from an edge of the lift tab across the longer panel to the diagonal opening assist score line thereon. When formed and sealed, the fold-over panel segment is confined between the edge portions of the longer and shorter panels. An extension is formed on one of the fold-back panels and sealed beneath the oppositely disposed fold-back panel.

2 Claims, 7 Drawing Figures

FLAT TOP END CLOSURE FOR LIQUID CONTAINER

TECHNICAL FIELD

This invention relates generally to thermoplastic coated paperboard containers and blanks for constructing same and, more particularly, to a folded flat top end closure therefor.

BACKGROUND ART

Containers for beverages such as milk and juices are conventionally constructed from thermoplastic coated paperboard. One common type of these containers includes a top end closure with a folded gable roof having a vertically projecting sealed fin at the roof ridge for sealing the container. Such containers are shown by U.S. Pat. No. 3,270,940. The bottom end closure for same in conventionally of the infolded type, such as that shown by U.S. Pat. No. 3,120,335.

Another type of container includes a slant top or a flat top end closure wherein what could otherwise be a vertically projecting sealed fin, or a slanted sealed fin, may be folded flat and releasably secured to the rest of the closure. U.S. Pat. Nos. 3,869,078 and 4,211,357 disclose such slant and/or flat top closures.

Various techniques have been employed to enhance the folding of a sealed fin in one particular direction to facilitate packing the containers in layers on top of each other to minimize storage and cargo space, without requiring any shipping tray between layers. For example, in U.S. Pat. No. 4,078,715 there is disclosed a top end closure with an inclined sealed fin that includes a "harder crease" on one side thereof than on the other for facilitating folding of the sealed fin from a vertical position to the inclined position.

U.S. Pat. Nos. 4,012,997 and 4,093,115 disclose a container folding method and the container made by the method, wherein one side of the gable panels of the top end closure is provided with double score lines extending parallel to each other. Folding of a sealed top fin of the end closure from a vertical position to a flat position requires the application of a downward force along the lower line of the double score line on one side of the sealed fin and the application of another force against the outside panel to bend the sealed fin downwardly.

In U.S. Pat. No. 4,206,867, a wide score line is formed on one side of the gable panels, in lieu of the above mentioned double score lines, with a conventional score line on the opposite side providing unequal fold-back panels on the two sides to facilitate folding the sealed top fin from a vertical position in a direction toward the smaller fold-back panels.

In the above-mentioned U.S. Pat. No. 4,211,357, unequal angles at the base of the infolded gable or gusset panels, with or without lower score lines on one side thereof than on the other, enhance folding in the direction of the larger base angles. In an alternative embodiment, a lowered and/or inclined wide score line provide the inclination to slant in one direction.

Still another type of container includes a flat top end closure wherein the sealed fin and features used to enhance flattening included in the above described flat end closures are not required, but wherein a pitcher pour spout is included, with overlapped lift tabs provided for easy opening of the pour spout. Such an arrangement is disclosed in U.S. Pat. No. 4,422,570.

DISCLOSURE OF THE INVENTION

An object of the invention is to provide an improved flat top end closure, without including a sealed fin arrangement, but having an external lift tab and tear strip integrally formed on one outer closure panel to assist in the opening of the, so-called, pitcher pour spout.

Another object of the invention is to provide a flat top end closure for a container, including two oppositely disposed outer closure panels which are adapted to lie flat on top of the underlying fold-in panels and wherein one edge overlaps a folded edge portion of the other one, with the longer one including a lift tab and tear strip for lifting a portion of the pour spout from its flat attitude during the opening process, and two oppositely disposed, three-segment fold-in panels, one of which serves as the pour spout when opened after peeling back the lift tab and tear strip along a perforated line formed in the panel overlying the three-segment pour spout panel.

These and other objects and advantages of the invention will be apparent when reference is made to the following description and accompanying drawings.

BEST MODE OF CARRYING OUT THE INVENTION

Figure 1:
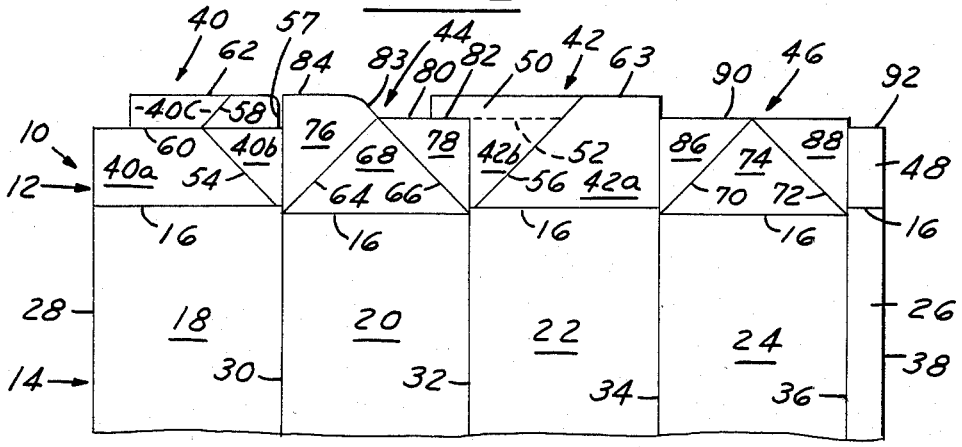
FIG. 1 is a fragmentary layout view of a blank from which the top end closure of the invention is formed, showing the outside surface thereof.

Referring now to the drawings in greater detail, FIG. 1 illustrates a blank 10 including a top closure portion and a body portion 14, separated by a staggered horizontal score line 16. The latter includes a first side panel 18, a front panel 20, a second side panel 22, a back panel 24, and a narrow fifth panel or side seam 26. The panels 18, 20, 22, 24 and 26 are defined, respectively, by a first free cut edge 28, vertical score lines 30, 32, 34, and 36, and a second free cut edge 38.

A pair of outer top panels 40 and 42 are integrally connected to the first and second side panels 18 and 22, respectively, at the score line 16. A pair of fold-in top panels 44 and 46 are integrally connected to the front and back panels 20 and 24, respectively, at the score line 16. The top panels are integrally connected to each other by the above-mentioned vertical score lines. An end closure extension 48 of the side seam 26 is integrally connected to the latter at the score line 16 and to the fold-in panel 46 at the score line 36. The panel 44 will serve as a pour spout, as will be explained.

A lift tab 50 is formed on the upper end of the top panel 42 by a perforated line 52, extending beyond the end of the score line 32, for a purpose to be described.

Opening-assist diagonal score lines 54 and 56 are formed on the outer top panels 40 and 42, respectively, the line 54 extending substantially from the intersection of the score line 30 and the horizontal score line 16 to a horizontal score line 60 formed on the panel 40, dividing the panel 40 into segments 40*a*, 40*b* and 40*c*. The edge of the panel segment 40*c* is separated from the extension of the score line 30 by a cut line 57. An oppositely disposed diagonal score line 58 extends from the intersection of the score lines 54 and 60 to the free cut edge 62 of the panel 40 for cooperation with the diagonal score line 54 during subsequent folding operations. The line 56 extends substantially from the intersection of the score lines 32 and 16 to the free cut edge 63 of the panel 42, dividing the panel 42 into segments 42*a* and 42*b*, the latter including the perforated line 52.

A pair of converging diagonal score lines 64 and 66 are formed on the fold-in top panel 44, forming with the horizontal score line 16 a triangular panel portion 68 adjacent the upper edge of the body front panel 20. Likewise, a pair of converging diagonal score lines 70 and 72 are formed on the fold-in top panel 46 so as to form with the horizontal score line 16 a triangular panel portion 74 adjacent the upper edge of the body back panel 24. The score lines 64, 66, 70 and 72 may be spaced at their lower ends slightly inward from the respective adjacent vertical score lines 30, 32, 34 and 36 along the horizontal score line 16, or may intersect the junctures of score lines 30 and 16, 32 and 16, 34 and 16, and 36 and 16, respectively, if desired.

There remains on the panel 44 a pair of fold-back panel portions consisting of a long panel portion 76 between the score lines 64 and 30, a short panel portion 78 between the score lines 66 and 32. It may be noted in FIG. 1 that a free cut edge 80 of the panel portion 78 extends from the vertical score line 32 to the apex of the triangular panel portion 68, such that the lift tab 50 extends part way across the panel portion 78, separated by a cut line 82 adjacent the free cut edge 80.

The other fold-back panel portion 76 extends beyond the intersection of the score lines 30 and 60 and the apex of the triangular panel portion 68, such that it includes a short diagonal free cut edge 83 aligned with the diagonal score line 66, and a lateral free cut edge 84 extending between the outer ends of the edge 83 and the score line 30. Thus, the panel portion 78 is substantially triangular in shape, defined by the score lines 32 and 66 and the edge 80, while the panel portion 76 is substantially four-sided in shape, defined by the score lines 30 and 64 and the edges 83 and 84.

The fold-in panel 46 includes fold-back panel portions 86 and 88 flanking the triangular panel portion 74, and each comparable to the panel portion 78. The panel portion 86 is defined by the score lines 34 and 70 and a free cut edge 90, the latter being substantially aligned with the free cut edge 80 of the panel portion 78. The panel portion 88 is defined by the score lines 36 and 72 and the free cut edge 90. A free cut edge 92 at the end of the side seam extension 48 aligns with the score line and edge 60 of the panel 40.

Figure 2:
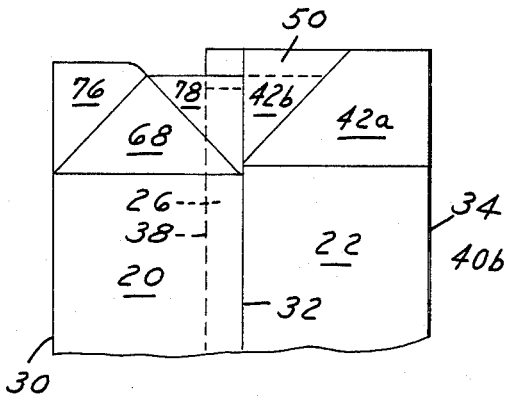
FIG. 2 is a fragmentary layout view of the outside surface of a blank after it is side seamed from the blank illustrated in FIG. 1.

The container blank 10 illustrated in FIG. 1 is formed into a side seamed blank, as illustrated in FIG. 2, by rotating the body panel 24 and the side seam flap 26 as a unit about the vertical score line 34, and having the inside surfaces of the body panel 24 come into contact with the inside surface of the body panel 22, with the vertical score line 36 positioned next to the vertical score line 32, and with the inside surface of the side seam flap 26 in contact with the inside surface of the body panel 20 adjacent the vertical score line 32. The body panel 18 is then rotated about the vertical score line 30 to bring its inside surface into contact with the outside surface of the side seam flap 26, and the edge 28 is positioned parallel and aligned with the vertical score line 36. The various members of the end closure 12 will make similar movements, and the container will appear as illustrated in FIG. 2. The container blank 10 is then sealed where the inside areas of the body panel 18 and the closure panel 40 come into contact with the outside surface of the side seam flap 26 and its extension 48.

Figure 3:
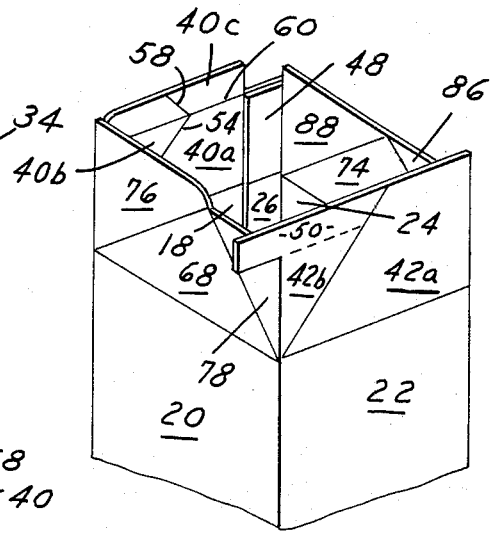
FIGS. 3, 4 and 5 are fragmentary perspective views illustrating sequentially various steps in forming the flat top end closure.
Figure 4:
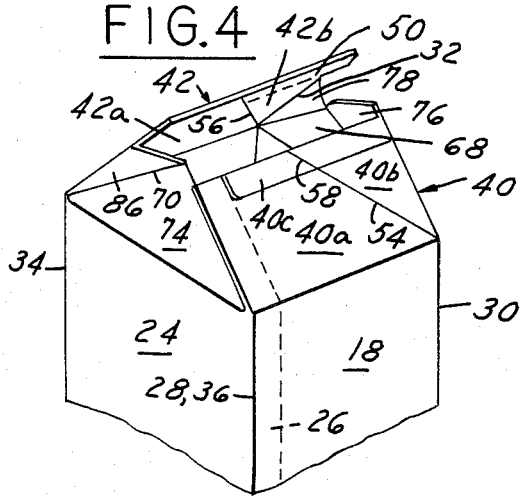

The next step in forming the side seam blank into a container is illustrated in FIG. 3. The side seam blank is opened up into a squared condition, after which the various parts of the end closure 12 are folded about the various score lines in the following manner. As may be noted from FIG. 4, the triangular closure panels 68 and 74 are moved around the horizontal score line 16 over the end of the container toward each other. The panel segment 40*c* is caused to bend around the score line 60 toward the panel segments 40*a* and 40*b*. At the same time, the outer panels 40 and 42 are also moved toward each other about the horizontal score line 16. This causes the fold-back panel portion 76 to rotate around the vertical score line 30 such that the inside surfaces of the panel portion 76 and the outer panel 40 are approaching each other. At the same time, the panel portion 76 is moved around the diagonal score line 64 such that the outside surfaces of the panel portion 76 and the triangular closure panel 68 are approaching each other. The fold-back panel portions 78, 86 and 88 make the same movements as described for the panel portion 76, with respect to their adjacent panels 42 and 68, 42 and 74, and 40 and 74, respectively. The lift tab 50 remains coplanar with the panel segment 42*b*.

Figure 5:
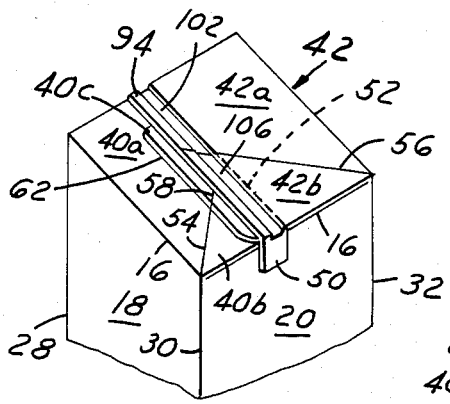
Figure 6:
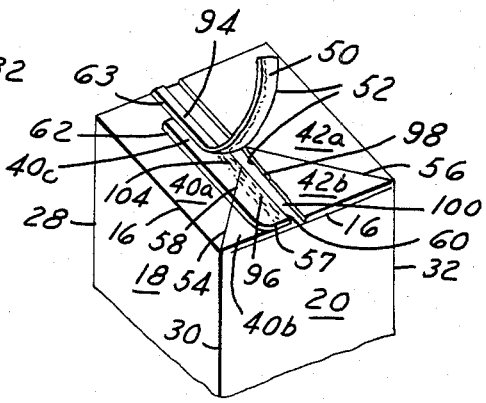
FIGS. 6 and 7 are fragmentary perspective views illustrating sequentially various steps in opening the flat top end closure into a pouring spout.
Figure 7:
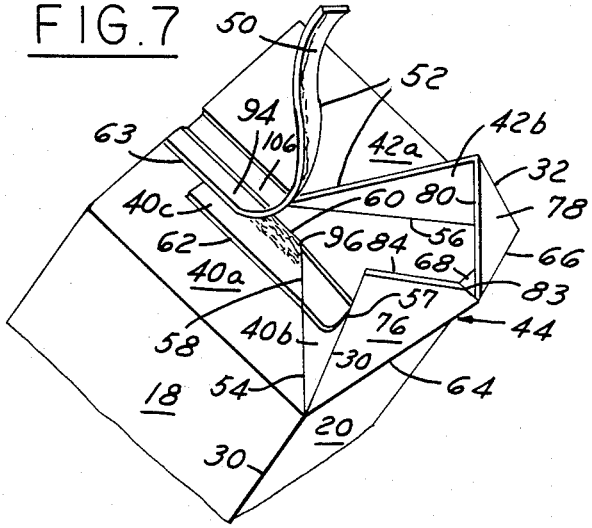

The outer panel 40 and the adjacent fold-back panels 76 and 88 are caused to move just enough faster than the outer panel 42 and the adjacent fold-back panels 78 and 86 such that the panel combination 40/76/88 is flattened before the overlying panel combination 42/78/86. The result, as shown in FIGS. 5 and 6, is that an edge portion 94 (FIG. 5) of the outer panel 42 overlaps an edge portion 96 (FIG. 6) of the outer panel segment 40*c* which is flattened against the panel segments 40*a* and 40*b*, with the diagonal score line 58 overlying the diagonal score line 54 (FIG. 7). The edge portion 98 of the panel segment 42*b* and the edge portion 80 of the panel segment 78 overlap the edge portion 100 of the panel 76. A strip portion 102 (FIG. 5) of the outer panel 42 adjacent the edge portion 94 is sealed to the strip portion 104 (FIG. 6) of the folded-over panel segment 40*c*, tending to cause a full width impression 106 (FIG. 5) on the outside of the closed and sealed top closure.

The free end of the lift tab 50 is bent downwardly about the score line 16 (FIG. 5) and sealed against the front panel 20 to accommodate shipping and stacking.

Referring now to FIG. 6, it may be noted that opening of the flat top closure is effectuated by first releasing the end of the lift tab 50 from the front body panel 24 and then tearing back the released tab along the perforated line 52. Thereafter, to open the pouring spout it is only necessary to lift the exposed portions of the folded-over segments 40*b* and 40*c* adjacent the diagonal score line 58 and the folded-over segment 42*b* adjacent the diagonal score line 56. This serves to lift not only the outer roof panel segments 40*b* and 42*b*, but also the underlying panel portions 76 and 78 (FIG. 7) and the intermediate triangular panel portion 68. This action occurs about the diagonal score lines 30, 32, 64 and 66 (FIG. 7). Specifically, once the panel segments 40*b* and 42*b* are partially lifted about the respective opening assist diagonal score lines 54, 58 and 56, the pour spout shown in FIG. 7 is then opened as follows: the panel portions 68, 76 and 78 of the panel 44 are caused to assume a substantially planar attitude, whereupon pressure against the vertical edge score lines 30 and 32 tends to cause the triangular panel portion 68 to extend outwardly (FIG. 7), into the usual pitcher pour spout for dispensing the contents of the container. The pour spout may, of course, be generally reclosed after use.

To further facilitate the opening process, it may be desirable to apply an "abhesive" or anti-sealant pattern to appropriate outside and/or inside surfaces of the opening panel, as is well known in the art.

INDUSTRIAL APPLICABILITY

It is apparent that the resultant flat top container may be stacked more readily during shipping and display than is the case with the conventional gable top container.

It should also be apparent that the flat top closure of the invention may be easily opened by virtue of the perforated lift tab integrally formed thereon.

It should be further apparent that the instant flat top closure is adaptable to a rectangular cross-sectional carton as well as to a carton with a square cross-section.

While but one embodiment of the invention has been shown and described, other modifications thereof are possible.

The embodiments of the invention in which an exclusive property or privilege is claims are defined as follows:

1. A blank for forming a flat top end closure for a liquid carrying, paperboard container, said blank comprising four side panels, first and second pairs of top closure panels alternately connected by respective horizontal score lines to the top edges of said four side panels as extensions thereof, said first pair of top closure panels each including a substantially triangular panel portion defined by converging diagonal score lines, and a pair of fold-back panels integrally connected to said substantially triangular panel portion at said diagonal score lines, said second pair of top closure panels including one shorter and one longer panel, a diagonal opening assist score line formed on each of said shorter and longer panels, a fold-over panel segment formed on the end of said shorter top closure panel, a reverse diagonal opening assist score line formed on said fold-over panel segment extending from an end of the adjacent diagonal opening assist score line, a lift tab formed on a side edge of said longer panel and extending past a portion of the adjacent fold-back panel, a perforated line extending across said longer top closure panel to the diagonal opening assist score line thereon aligned with an edge of said lift tab and the edge of said adjacent fold-back panel, and an extension formed on the fold-back panel adjacent said fold-over panel segment adapted to serve as an underlying segment for said perforated line when said blank is formed into a container.

2. A flat top liquid carrying, paperboard container comprising four side panels, first and second pairs of top closure panels alternately connected by respective horizontal score lines to the top edges of said four side panels as extensions thereof, said first pair of top closure panels each including a substantially triangular panel portion defined by converging diagonal score lines, and a pair of fold-back panels integrally connected to said substantially triangular panel portion at said diagonal score lines, said second pair of top closure panels being outer panels and including one shorter and one longer panel, said fold-back panels being confined between respective outer panels and triangular panel portions, a diagonal opening assist score line formed on each of said shorter and longer panels, a fold-over panel segment formed on the end of said shorter top closure panel, a reverse diagonal opening assist score line formed on said fold-over panel segment extending from an end of the adjacent diagonal opening assist score line, a lift tab formed on a side edge of said longer panel and extending past a portion of the adjacent fold-back panel, a perforated line for forming a tear strip extending across said longer top closure panel to the diagonal opening assist score line thereon aligned with an edge of said lift tab and the edge of the adjacent fold-back panel, said fold-over panel segment being confined between the edge portions of said longer panel and said shorter panel, and an extension formed on one of the fold-back panels and confined between said adjacent fold-back panel and the underlying portion of the adjacent triangular panel portion and beneath said perforated line.

* * * * *